US007718908B2

(12) United States Patent
Mruthunjaya et al.

(10) Patent No.: US 7,718,908 B2
(45) Date of Patent: May 18, 2010

(54) CONTACT ARM ASSEMBLY AND METHOD FOR ASSEMBLING THE CONTACT ARM ASSEMBLY

(75) Inventors: Girish Hassan Mruthunjaya, Farmington, CT (US); Jayesh Mavji Maru, Andhra Pradeshsh (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/243,306

(22) Filed: Oct. 1, 2008

(65) Prior Publication Data

US 2010/0078299 A1 Apr. 1, 2010

(51) Int. Cl.
*H01H 1/22* (2006.01)

(52) U.S. Cl. ..... 200/244

(58) Field of Classification Search ..... 200/244, 200/400, 401; 218/22–27; 335/16, 147, 335/195, 166, 6, 202
See application file for complete search history.

(56) References Cited

U.S. PATENT DOCUMENTS

| | | | | |
|---|---|---|---|---|
| 3,239,621 | A * | 3/1966 | Baulier et al. | 200/401 |
| 5,361,051 | A * | 11/1994 | DiMarco et al. | 335/16 |
| 5,363,076 | A * | 11/1994 | Miller et al. | 335/16 |
| 5,844,455 | A * | 12/1998 | Song | 335/16 |
| 5,866,996 | A * | 2/1999 | Navarre | 218/22 |
| 6,259,048 | B1 * | 7/2001 | Castonguay et al. | 200/244 |
| 6,747,532 | B1 * | 6/2004 | Tobin et al. | 335/6 |
| 6,870,112 | B2 * | 3/2005 | Bresciani et al. | 200/244 |
| 6,924,445 | B2 * | 8/2005 | Bresciani et al. | 200/244 |
| 6,975,190 | B2 * | 12/2005 | Sato et al. | 335/16 |
| 7,189,935 | B1 * | 3/2007 | Hassan et al. | 200/244 |
| 7,351,927 | B1 * | 4/2008 | Rakus et al. | 200/244 |
| 2008/0087537 | A1 | 4/2008 | Weister et al. | |

FOREIGN PATENT DOCUMENTS

EP 1968093 A2 9/2008

OTHER PUBLICATIONS

European Search Report for Application No.: 09171156.4; Date of Mailing: Jan. 25, 2010; 5 pgs.

* cited by examiner

*Primary Examiner*—Michael A Friedhofer
(74) *Attorney, Agent, or Firm*—Cantor Colburn LLP

(57) ABSTRACT

A contact arm assembly and a method for assembling the contact arm assembly are provided. The contact arm assembly includes a first contact arm having a first end portion and a second end portion. The first end portion has a first contact disposed thereon and a first spring holder portion disposed thereon. The second end portion has a first tab member for coupling a first braided strap thereto. The first contact arm has a first pivot aperture extending therethrough. The contact arm assembly further includes first and second side plates. The first side plate is disposed proximate to a first side of the first contact arm and the second side plate is disposed proximate to a second side of the first contact arm.

5 Claims, 11 Drawing Sheets

CONTACT ARM ASSEMBLY AND METHOD FOR ASSEMBLING THE CONTACT ARM ASSEMBLY

FIELD OF INVENTION

This application relates to a contact arm assembly and a method for assembling the contact arm assembly.

BACKGROUND

Circuit breakers have been utilized to protect electrical equipment from overcurrent conditions. However, the circuit breakers generally have contact arms with a multitude of components that are relatively expensive to manufacture.

Further, double break breakers have been developed. However, designers have not been able to convert the double break breaker into a single break breaker within a similar housing configuration, resulting in increased manufacturing costs.

Accordingly, the inventors herein have recognized a need for an improved contact arm assembly that minimizes and/or eliminates the above-mentioned deficiency.

BRIEF DESCRIPTION

A contact arm assembly in accordance with the exemplary embodiment is provided. The contact arm assembly includes a first contact arm having a first end portion and a second end portion. The first end portion has a first contact disposed thereon and a first spring holder portion disposed thereon. The second end portion has a first tab member for coupling a first braided strap thereto. The first contact arm has a first pivot aperture extending therethrough. The contact arm assembly further includes first and second side plates. The first side plate is disposed proximate to a first side of the first contact arm and the second side plate is disposed proximate to a second side of the first contact arm. The first side plate has a first spring support groove thereon and a first aperture extending therethrough. The second side plate has a second spring support groove thereon and a second aperture extending therethrough. The contact arm assembly further includes a first spring support pin disposed in the first and second spring support grooves of the first and second side plates, respectively. The contact arm assembly further includes a pivot pin disposed through the first circular pivot aperture of the first contact arm and into the first and second apertures of the first and second side plates, respectively. The contact arm assembly further includes a first spring disposed between the first spring holder portion of the first contact arm and the first spring support pin.

An advantage of the contact arm assembly is that it can be utilized in a single break breaker housing that is similar to a housing of a double break breaker.

A method for assembling a contact arm assembly in accordance with another exemplary embodiment is provided. The method includes coupling a first contact on a first end portion of a first contact arm. The method further includes coupling a first braided strap on a first tab member of a second end portion of the first contact arm. The method further includes disposing a pivot pin through a first pivot aperture of the first contact arm. The method further includes disposing a first side plate proximate to a first side of the first contact arm. The method further includes disposing a second side plate proximate to a second side of the first contact arm such that the pivot pin extends into first and second apertures of the first and second side plates, respectively to form a first assembly. The method further includes disposing the first assembly in a cavity of a rotor housing. The method further includes disposing a first spring support pin in first and second spring support grooves of the first and second side plates, respectively. The method further includes attaching a first spring between a first spring holder portion of the first contact arm and the first spring support pin to obtain the contact arm assembly.

DETAILED DESCRIPTION

Figure 1:
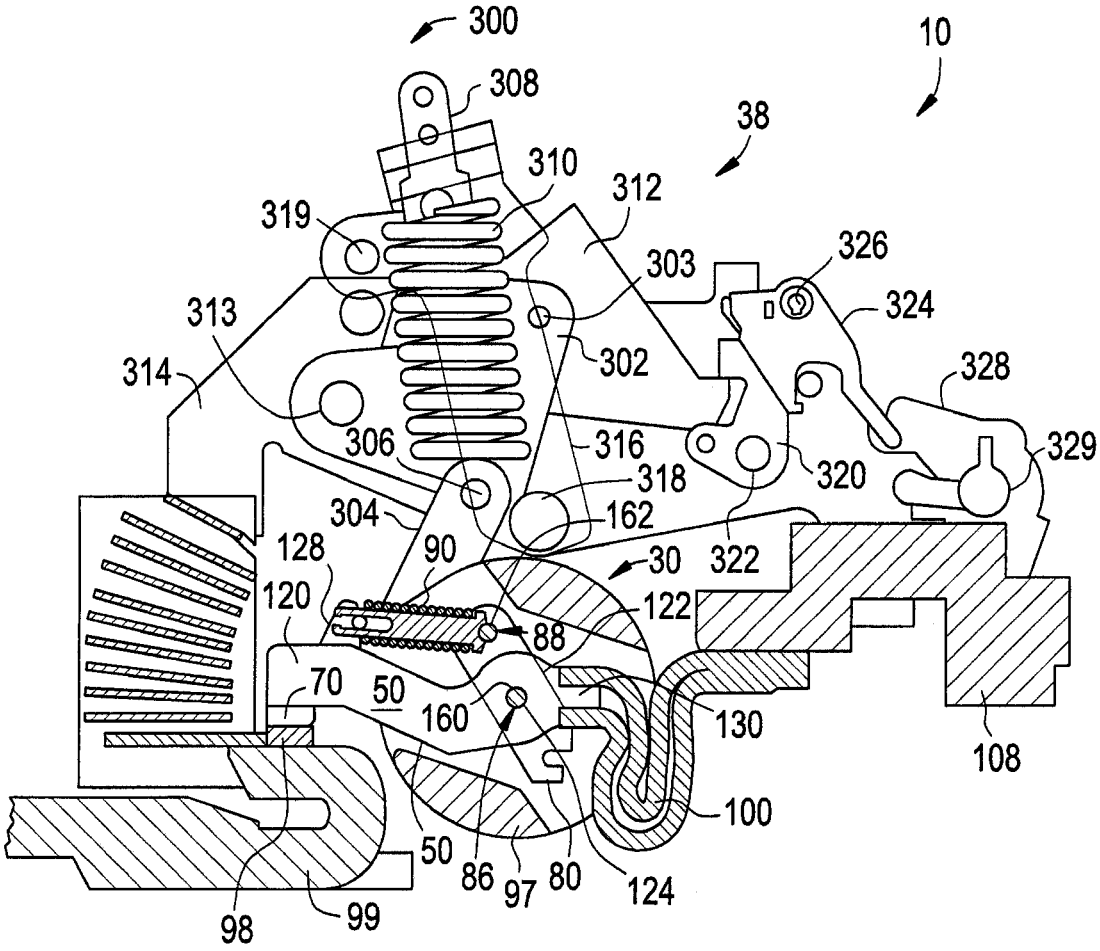
FIG. 1 is a schematic of a circuit breaker in accordance with an exemplary embodiment.
Figure 2:
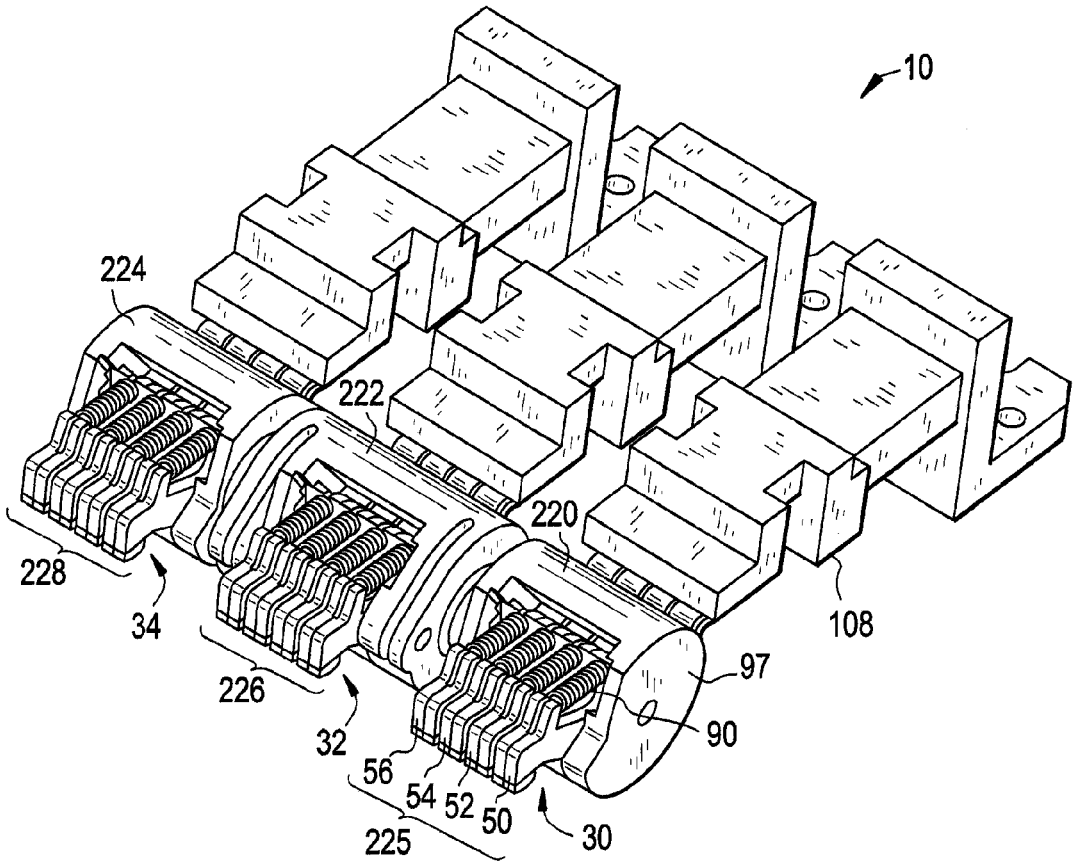
FIG. 2 is a schematic of contact arm assemblies utilized in the circuit breaker of FIG. 1.

Referring to FIGS. 1 and 2, a circuit breaker 10 in accordance with an exemplary embodiment is illustrated. The circuit breaker 10 includes contact arm assemblies 30, 32, 34, and a switching assembly 38. The circuit breaker 10 is a single break circuit breaker. As shown in FIG. 1, the contact arm assembly 30 has a closed operational position in which electrical current can flow therethough.

Figure 3:
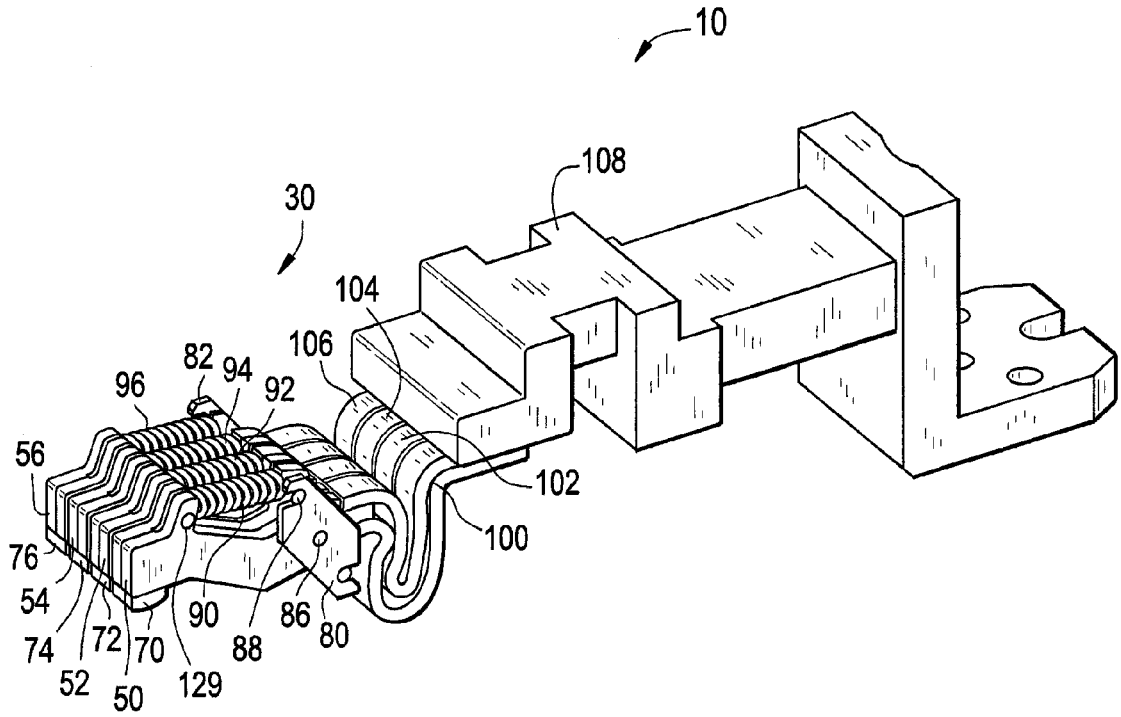
FIG. 3 is a schematic of a contact arm assembly of FIG. 2.

Since the contact arm assemblies 30, 32, 34 have a substantially similar configuration, only the contact arm assembly 30 will be discussed in greater detail below. Referring to FIGS. 1, 2 and 3, the contact arm assembly 30 includes contact arms 50, 52, 54, 56, contacts 70, 72, 74, 76, side plates 80, 82, a pivot pin 86, a pin 88, spring assemblies 90, 92, 94, 96, a rotor 97, a stationary contact 98 and three other stationary contacts (not shown), a line strap 99, braided straps 100, 102, 104, 106, and a load strap 108.

The contact arms 50, 52, 54, 56 are sandwiched between the side plates 80, 82 and when rotated to the closed operational state, conduct an electrical current from the line strap 99 to the load strap 108—via the stationary contact 98 and three additional stationary contacts (not shown), the contacts 70, 72, 74, 76, and the braided straps 100, 102, 104, 106. Since the contact arms 50, 52, 54, 56 have a substantially similar configuration, only the contact arms 50, 56 will be explained in greater detail below.

Referring to FIGS. 1 and 3, the contact arm 50 has an end portion 120, an end portion 122, and a circular pivot aperture 124. The end portion 120 includes a spring holder portion 128 having a groove 129 for holding an end of the spring assembly 90 thereon. The contact 70 is disposed on the end portion 120 opposite to the spring holder portion 128. The end portion 122 has a tab portion 130 that is coupled to the braided strap 100. The contact arm 50 is disposed between the side plate 80 and the contact arm 52 and the pivot pin 86 extends through the circular pivot aperture 124 of the contact arm 50 and into an aperture of the side plate 80. It can be noted that the pivot pin 86 further extends through circular pivot apertures in each of the contact arms 50, 52, 54, 56 such that the contact arms can rotate about the pivot pin 86.

Figure 5:
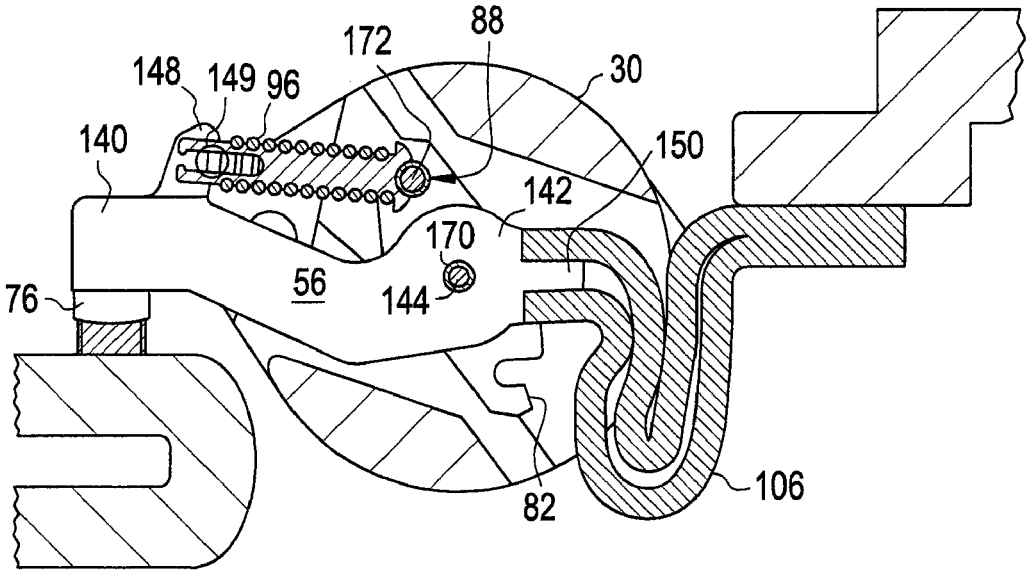
FIG. 5 is a schematic of another contact arm assembly utilized in the circuit breaker of FIG. 1.

Referring to FIGS. 3 and 5, the contact arm 56 has an end portion 140, an end portion 142, and a circular pivot aperture 144. The end portion 140 includes a spring holder portion 148 having a groove 149 for holding an end of the spring assembly 96 thereon. The contact 76 is disposed on the end portion 140 opposite to the spring holder portion 148. The end portion 142 has a tab portion 150 configured to be coupled to the braided strap 106. The contact arm 56 is disposed between the side plate 82 and the contact arm 54 and the pivot pin 86 extends through the circular pivot aperture 144 of the contact arm 56 and into an aperture of the side plate 82.

Figure 4:
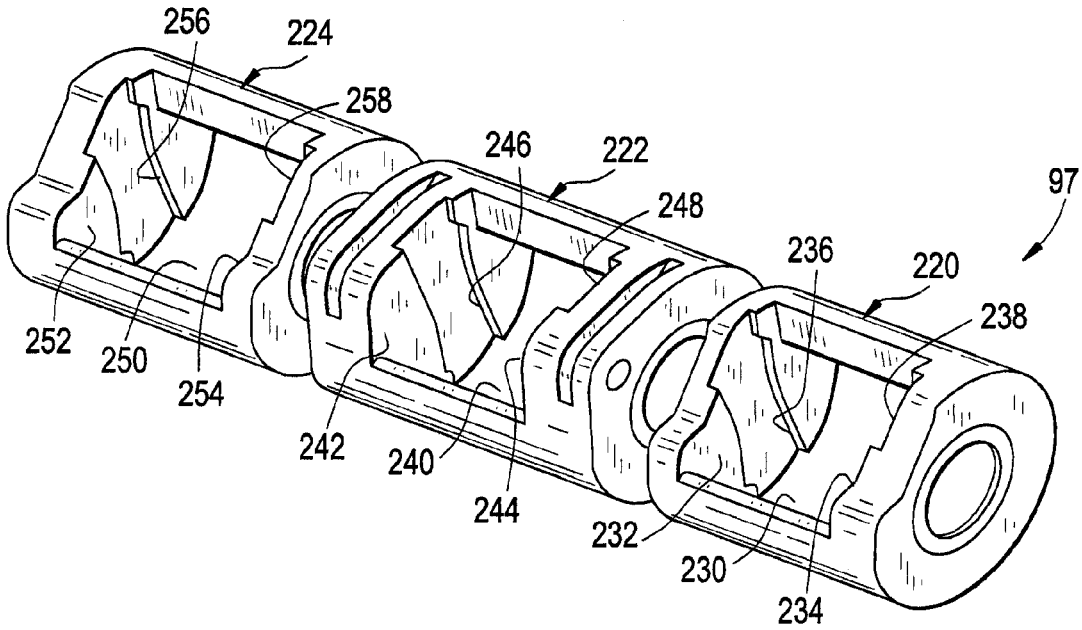
FIG. 4 is a schematic of a rotor utilized in the contact arm assembly of FIG. 3.

Referring to FIGS. 1, 3 and 4, the side plates 80, 82 are disposed on opposite sides of the contact arms 50, 52, 54, 56 and are configured to be disposed within grooves 238, 236, respectively, of the housing 220 of the rotor 97. Accordingly, the side plates 80, 82 rotate with the rotor 97.

The side plate 80 includes a spring support groove 162 for receiving a pin 88 that holds an end of the spring assembly 90. Thus, the spring assembly 90 is disposed between the pin 88 and the spring holder portion 128 of the contact arm 50. The spring assembly 90 biases the contact arm 50 in a counter-clockwise direction toward the stationary contact 98. The side plate 80 further includes an aperture 160 extending therethrough for receiving the pivot pin 86 therein.

Referring to FIGS. 4 and 5, the side plate 82 includes a spring support groove 172 for receiving the pin 88 that holds an end of the spring assembly 96. Thus, the spring assembly 96 is disposed between the pin 88 and the spring holder portion 148 of the contact arm 56. The spring assembly 96 biases the contact arm 56 in a counter-clockwise direction toward a respective stationary contact. The side plate 82 further includes an aperture 170 extending therethrough for receiving the pivot pin 86 therein. It should be noted that the spring assemblies 92, 96 are disposed between the pin 88 and spring hold portions on the contact arms 52, 54, respectively.

Referring to FIG. 3, the spring assemblies 90, 92, 94, 96 are configured to bias the contact arms 50, 52, 54, 56 in a counter-clockwise direction toward respective stationary contacts. Since the spring assemblies 90, 92, 94, 96 having a substantially similar structure, only the spring assembly 90 will discussed in greater detail below.

Figure 6:
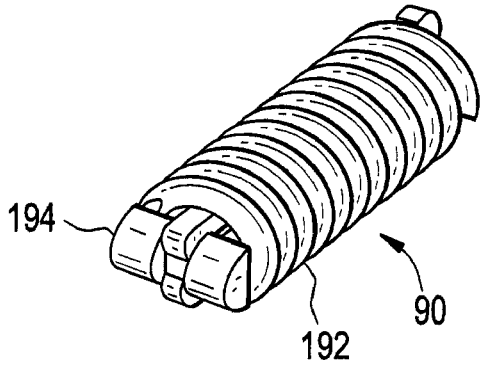
FIG. 6 is a schematic of a spring assembly utilized in the contact arm assembly of FIG. 3.
Figure 7:
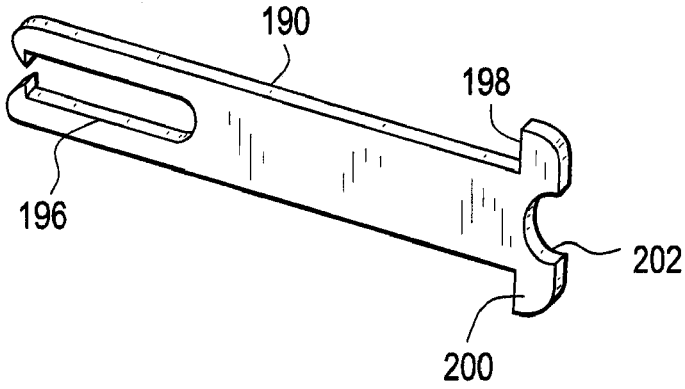
FIG. 7 is a schematic of a spring guide plate utilized in the spring assembly of FIG. 6.
Figure 8:
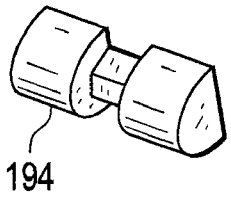
FIG. 8 is a schematic of a spring retainer utilized in the spring assembly of FIG. 6.

Referring to FIGS. 6-8, the spring assembly 90 includes a spring guide plate 190, a spring 192, and a spring retainer 194. The spring guide plate 190 is configured to receive the spring 190 thereon and supports the spring 192. The spring guide plate 190 includes a slot 196 for receiving a portion of the spring retainer 194 therein. The spring guide plate 190 further includes flange portions 198, 200 configured to hold an end of the spring 90 thereon. The spring guide plate 190 further includes a mating surface 202 configured to receive the pin 88 (shown in FIG. 3) therein. The spring retainer 194 is configured to be disposed with the slot 196 of the spring guide plate 190 such that the spring 192 is held between the spring retainer 194 and the flange portions 198, 200 of the spring guide plate 190.

Referring to FIGS. 1, 2 and 4, the rotor 97 is provided to rotate and to hold the contact arms in a tripped (i.e., open) operational state when an over-current condition has been detected through the contact arm assemblies. The rotor 97 includes housings 220, 222, 224.

The housing 220 holds a first set of contact arms 225 including the contact arms 50, 52, 54, 56 therein. In particular, the housing 220 includes a cavity 230 for holding the contact arms 50, 52, 54, 56 therein. Further, the housing 220 includes side walls 232, 234 having grooves 236, 238, respectively, for receiving the side plates 82, 80, respectively, therein.

The housing 222 holds a second set of contact arms 226 therein. In particular, the housing 222 includes a cavity 240 for holding the second set of contact arms 226 therein. Further, the housing 220 includes side walls 242, 244 having grooves 246, 248, respectively, for receiving the two side plates therein.

The housing 224 holds a third set of contact arms 228 therein. In particular, the housing 224 includes a cavity 250 for holding the third set of contact arms 228 therein. Further, the housing 224 includes side walls 252, 254 having grooves 256, 258, respectively, for receiving the two side plates therein.

Referring to FIG. 3, the braided straps 100, 102, 104, 106 are electrically coupled to the contact arms 50, 52, 54, 56, respectively. Further, the braided straps 100, 102, 104, 106 are electrically coupled to the load strap 108.

A general overview of the operation of the contact arm assembly 30 with respect to the contact arm 50 will now be provided. It should be understood that the other contact arms in contact arm assembly 30 operate in a similar manner as contact arm 50. Referring to FIG. 1, the contact arm assembly 30 has a closed operational state such that the contact 70 on the contact arm 50 contacts the stationary contact 98. Further, the contact arm assembly 30 allows electrical current to flow through the lines strap 99, the stationary contact 98, the contact 70, the contact arm 50, the braided strap 100, and the load strap 108.

Figure 9:
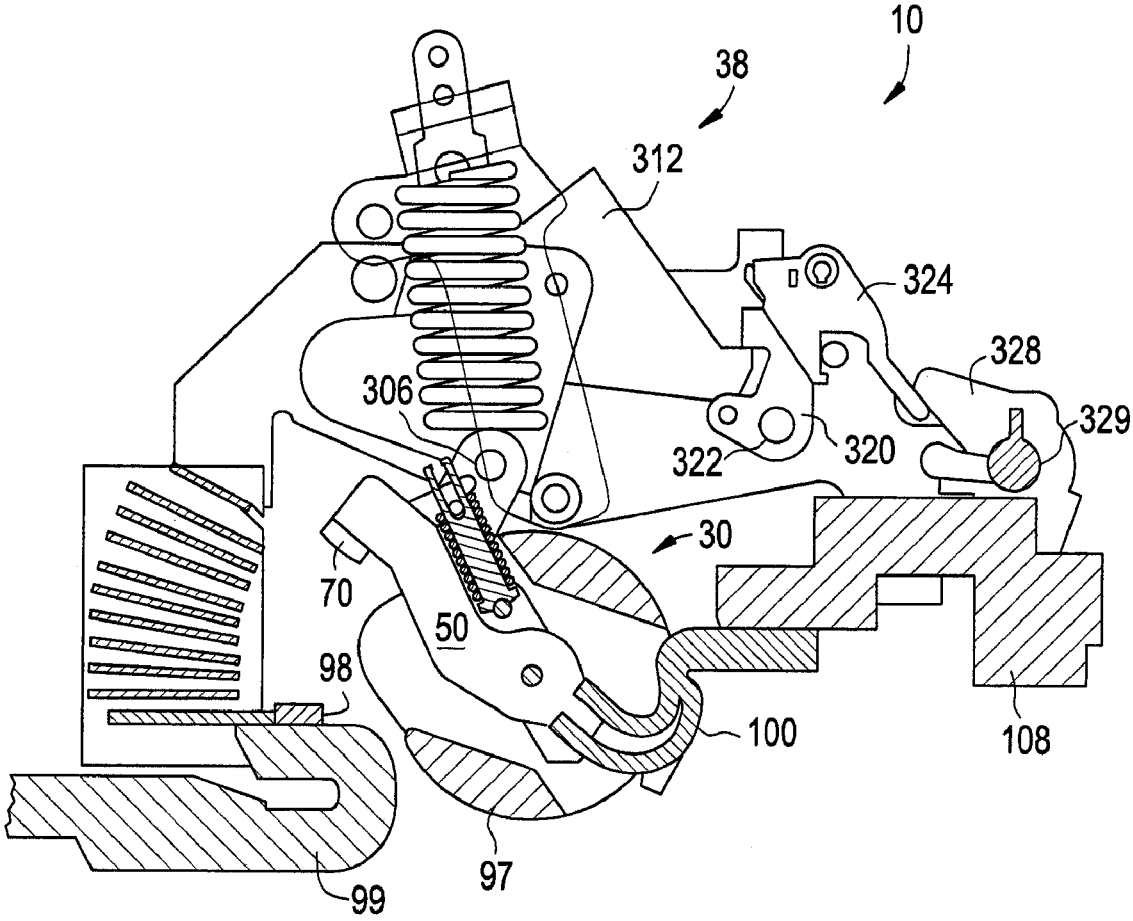
FIG. 9 is a schematic of the circuit breaker of FIG. 1 in a blow open operational state.

Referring to FIG. 9, when an overcurrent condition occurs, repulsive forces between the contact arm 50 and the stationary contact 98 urge the contact arm 50 away from the stationary contact 98 in a clockwise direction such that contact 70 on the contact arm 50 no longer contacts the stationary contact 98 and the contact arm 50 has a blow open operational state.

Figure 10:
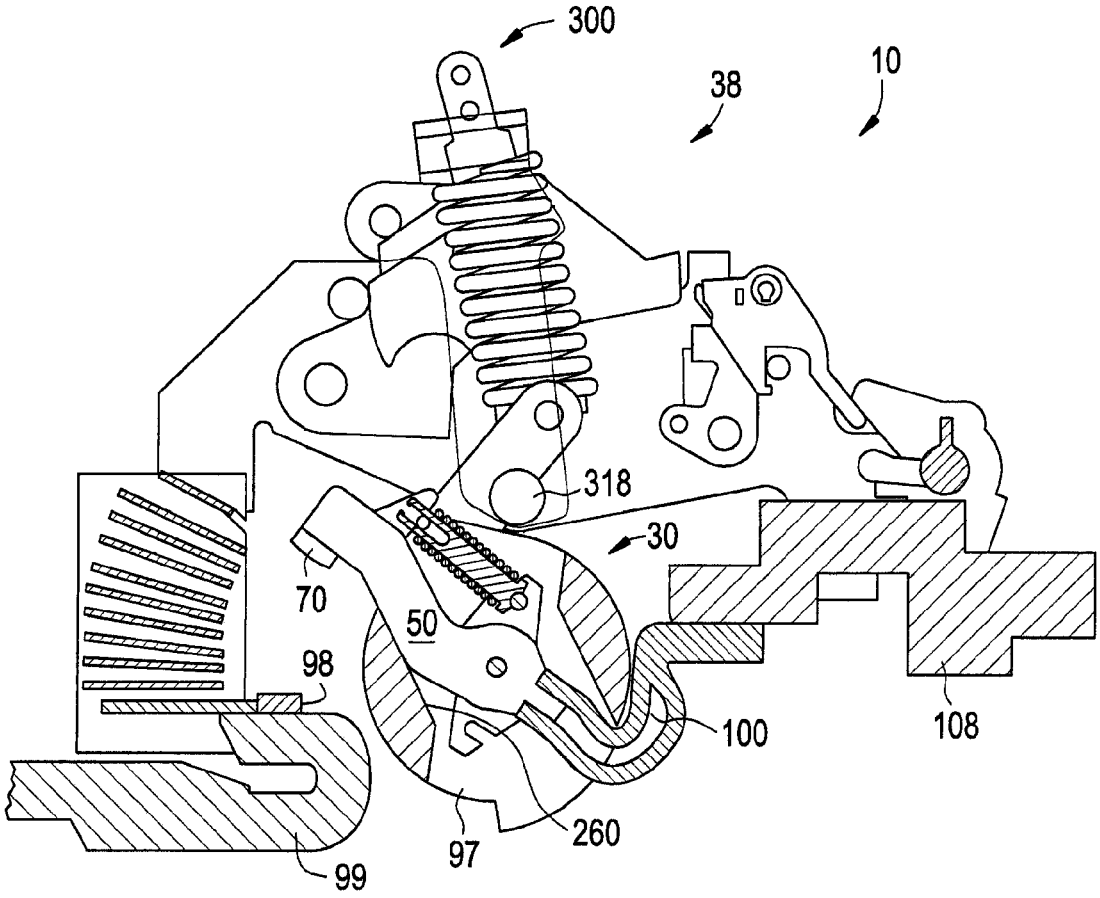
FIG. 10 is a schematic of the circuit breaker of FIG. 1 in a tripped operational state.

Referring to FIG. 10, after the overcurrent condition occurs, the rotor 97 is rotated in a clockwise direction by the switching assembly 38 such that a surface 260 of the rotor 96 contacts the contact arm 50 to hold the contact arm 50 in a tripped (i.e., open) operational state such that no electrical current flows through the contact arm 50.

Figure 11:
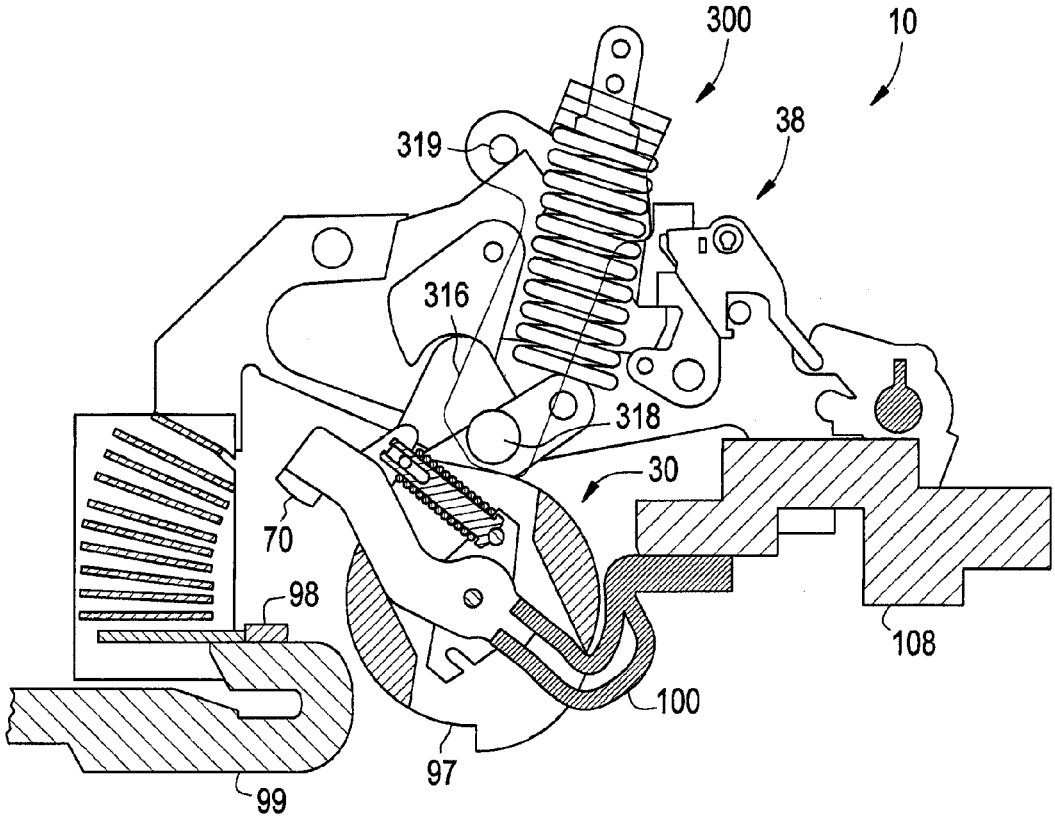
FIG. 11 is a schematic of the circuit breaker of FIG. 1 in an off operational state.

Referring to FIG. 11, when a user rotates the handle 300 of the switching assembly 38 in a clockwise direction, the switching assembly 38 urges the rotor 97 to rotate in a clockwise direction. As a result, the surface 260 of the rotor 96 contacts the contact arm 50 and moves the contact arm 50 to an off operational state such that no electrical current flows through the contact arm 50.

Figure 12:
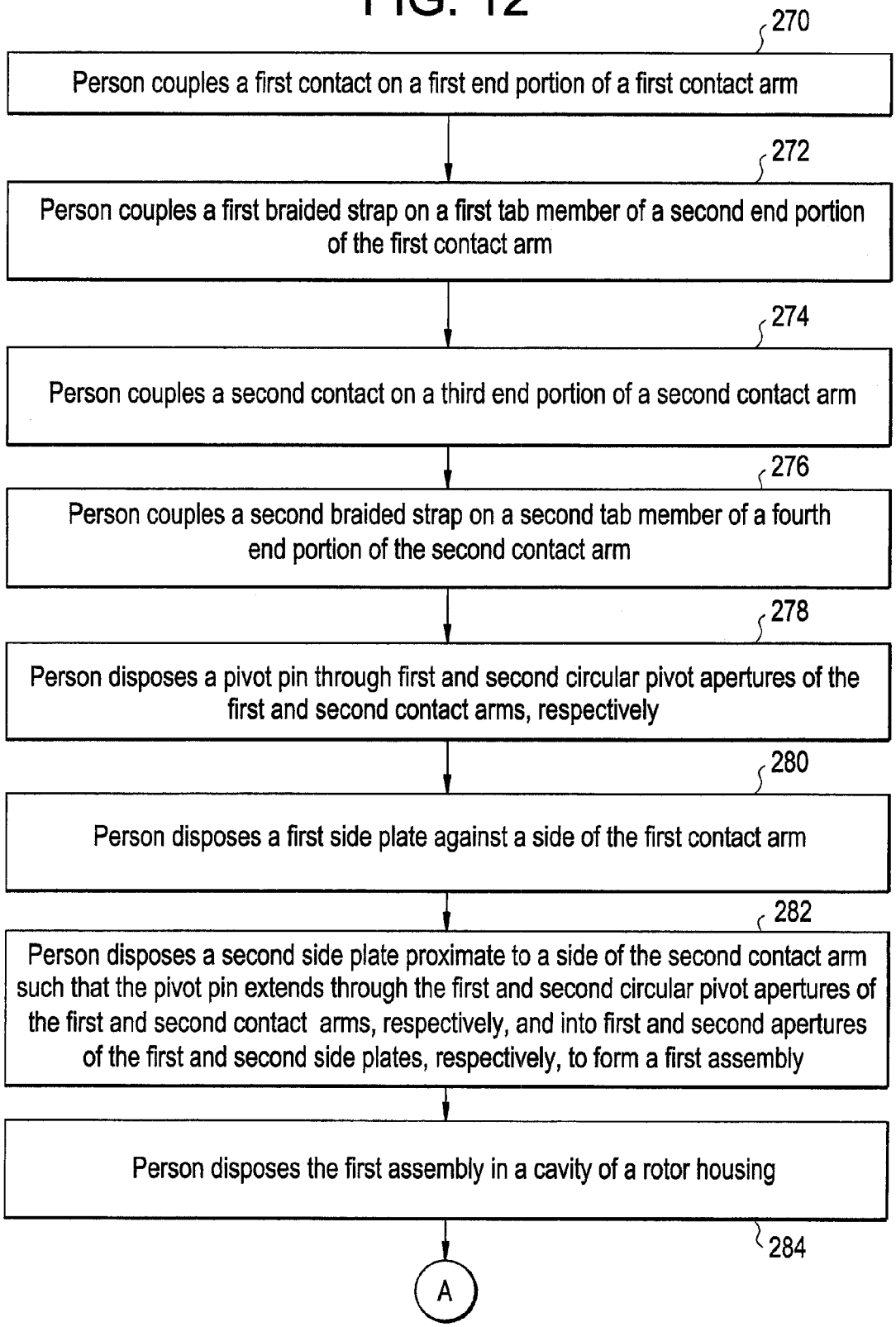
FIGS. 12-13 are flowcharts of a method for assembling the contact arm assembly of FIG. 3.
Figure 13:
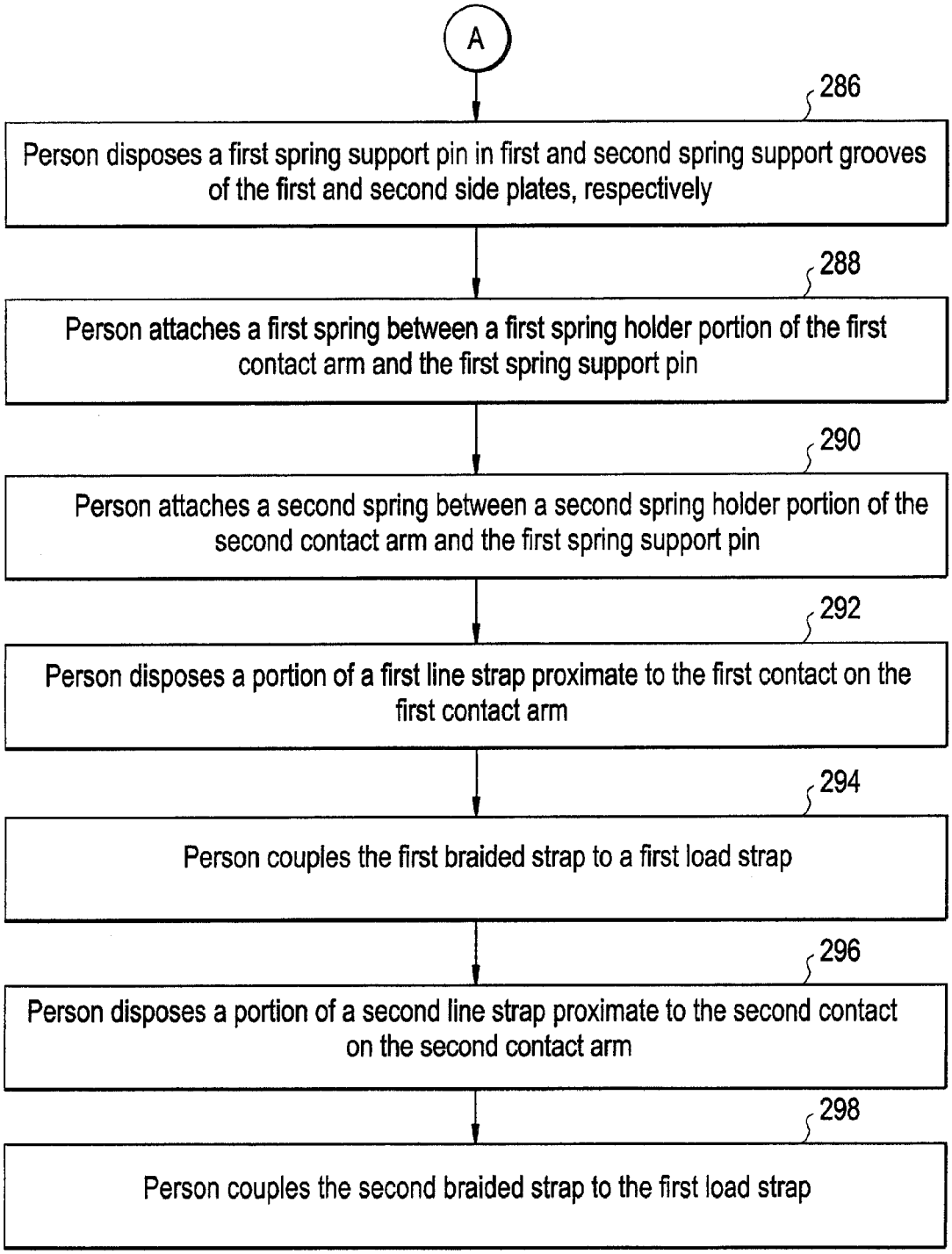

Referring to FIGS. 12 and 13, a flowchart of a method for assembling the contact arm assembly 30 will now be explained. For purposes of simplicity, the method will include steps for assembling the contact arm assembly 30 with only the contact arms 50, 56. However, it should be understood that the method could alternately be adapted to assemble a contact arm assembly with a single contact arm or with a plurality of contact arms such as contact arms 50, 52, 54, 56. It should be further noted that in the non-limiting exemplary flowchart some of the following steps are performed by a person. However, the following steps could be alternatively be performed by one or more machines in an automated process instead of by the person.

At step 270, a person couples the first contact 70 on the first end portion 120 of the first contact arm 50.

At step 272, the person couples the first braided strap 100 on the first tab member 130 of the second end portion 122 of the first contact arm 50.

At step 274, the person couples the second contact 76 on the third end portion 140 of the second contact arm 56.

At step 276, the person couples the second braided strap 106 on the second tab member 150 of the fourth end portion 142 of the second contact arm 56.

At step 278, a person disposes the pivot pin 86 through first and second circular pivot apertures of the first and second contact arms 50, 56, respectively.

At step 280, the person disposes the first side plate 80 against a side of the first contact arm 50.

At step 282, the person disposes the second side plate 82 proximate to a side of the second contact arm 56 such that the pivot pin 86 extends through the first and second circular pivot apertures of the first and second contact arms 50, 56, respectively, and into first and second apertures of the first and second side plates 80, 82, respectively, to form a first assembly.

At step 284, the person disposes the first assembly in that cavity 230 of the rotor housing 220.

At step 286, the person disposes a first spring support pin 88 in first and second spring support grooves of the first and second side plates 80, 82, respectively.

At step 288, the person attaches a first spring between a first spring holder portion of the first contact arm 50 and the first spring support pin 88.

At step 290, the person attaches a second spring between a second spring holder portion of the second contact arm 56 and the first spring support pin 88.

At step 292, the person disposes a portion of a first line strap 99 proximate to the first contact 98 on the first contact arm 50.

At step 294, the person couples the first braided strap 100 to the first load strap 108.

At step 296, the person disposes a portion of a second line strap proximate to the second contact 76 on the second contact arm 56.

At step 298, the person couples the second braided strap 106 to the first load strap 108.

Referring to FIG. 1, the switching assembly 38 will now be explained. The switching assembly 38 is provided to transition the contact arm assemblies 30, 32, 34 from a closed operational state in which electrical current is conducted through the contact arm assemblies to an off (i.e., open) operational state in which no electrical current is conducted through the contact arm assemblies, and vice versa. For purposes of simplicity, the following discussion, will focus on the operation of the switching assembly 38 on the contact arm assembly 30.

The switching assembly 38 includes a handle 300, an upper link 302, a hinge pin 303, a lower link 304, a toggle pin 306, a spring support 308, a spring 310, a cradle 312, a housing portion 314, a handlebar 316, a pin 318, a primary latch 320, a pin 322, a secondary latch 324, a pin 326, a trip bar 328, and a pin 329

The handle 300 is coupled to the upper link 302. The upper link 302 is rotatably coupled to the lower link 304 via the toggle pin 306. The toggle pin 306 is further coupled to the cradle 312 and an end of the spring support 308. The lower link 304 is further coupled to the rotor 97.

The spring 310 is disposed on the spring support 308 that extends between the handle 300 and the toggle pin 306. The spring 310 is configured to bias the upper link 300 and the lower link 304 such that the lower link 304 pushes the contact arm 54 toward the stationary contact 98 when the handle 300 is at a maximum leftward position.

When a user rotates the handle 300 in a clockwise direction to transition the contact arm assembly 30 from the closed operational state to an off (i.e., open) operational state, the upper link 302 moves the lower link 300 such that the lower link 304 rotates the rotor 97 in a clockwise direction to move the contact 70 away from the stationary contact 98.

The cradle 312 is rotatably coupled to the housing portion 314 via the pin 313. Further, the cradle 312 is coupled to the upper link 302 via the hinge pin 303 of the upper link 302. The cradle 312 is further detachably coupled to the primary latch 320. The primary latch 320 rotates about the pin 322. The primary latch 320 is further rotatably coupled to the secondary latch 324. The secondary latch 324 rotates about the pin 326. The secondary latch 324 is further rotatably coupled to the trip bar 328. The trip bar 320 rotates about the pin 329.

Referring to FIGS. 9 and 10, during operation when an overcurrent condition occurs through the contact arm assembly 30 and the contact arm assembly 30 has a blow open operational state, the trip bar 328 rotates in a counterclockwise direction. In response to the trip bar 328 rotating in a counterclockwise direction, the secondary latch 324 rotates in a clockwise direction. Further, the secondary latch 324 induces the primary latch 320 to rotate in a clockwise direction. As result, the cradle 312 moves in a counterclockwise direction which urges the lower link 304 to move upwardly which rotates the rotor 97 in a clockwise direction. Further, rotation of the rotor 97 in the clockwise direction causes the surface 260 of the rotor 97 to contact the contact arm 50 for maintaining the contact arm 50 at an open position away from the stationary contact 98 and the contact arm assembly has a tripped operational state.

Referring to FIGS. 10 and 11, after the contact arm assembly 30 has the tripped operational state, a user can reset the contact arm assembly 30 to an off operational state by rotating the handle 300 in a clockwise direction. In particular, the handle 300 is coupled to the handle bar 316 that rotates about the pin 318. The handle bar 316 further includes a pin 319. During rotation of both the handle 300 and the handle bar 316 in a clockwise direction, the pin 319 contacts the cradle 312 and moves the cradle rightwardly such that the cradle 312 is latched by the primary latch 320.

The contact arm assembly and the method for assembling the contact arm assembly provide a substantial advantage over other assemblies and methods. In particular, the contact arm assembly and method provide a technical effect of utilizing a relatively small number of components that substantially reduces manufacturing costs as compared to other assemblies.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiments disclosed for carrying out this invention, but that the invention includes all embodiments falling with the scope of the appended claims. Moreover, the use of the terms first, second, etc. does not denote any order of importance, but rather the terms first, second, etc. are used to distinguish one element from another.

The invention claimed is:

1. A contact arm assembly, comprising:

a first contact arm having a first end portion and a second end portion, the first end portion having a first contact disposed thereon and a first spring holder portion disposed thereon, the second end portion having a first tab member extending therefrom, the first tab member being rectangular shaped and having first and second sides, a first braided strap portion being coupled to the first side, and a second braided strap portion being coupled to the second side, the first contact arm having a first pivot aperture extending therethrough;

first and second side plates, the first side plate is disposed proximate to a first side of the first contact arm and the second side plate is disposed proximate to a second side of the first contact arm, the first side plate having a first spring support groove thereon and a first aperture extending therethrough, the second side plate having a second spring support groove thereon and a second aperture extending therethrough;

a first spring support pin disposed in the first and second spring support grooves of the first and second side plates, respectively;

a pivot pin disposed through the first pivot aperture of the first contact arm and into the first and second apertures of the first and second side plates, respectively; and a first spring disposed between the first spring holder portion of the first contact arm and the first spring support pin.

2. The contact arm assembly of claim 1, further comprising:

a second contact arm having a third end portion and a fourth end portion, the third end portion having a second contact disposed thereon and a second spring holder portion disposed thereon, the fourth end portion having a second tab member extending therefrom, the second tab member being rectangular shaped and having third and fourth sides, a third braided strap portion being coupled to the third side, and a fourth braided strap portion being coupled to the fourth side, the second contact arm having a second pivot aperture extending therethrough;

the second contact arm disposed between the first contact arm and the second side plate;

the pivot pin disposed through the first pivot aperture of the first contact arm, the second pivot aperture of the second contact arm, and into the first and second apertures of the first and second side plates, respectively; and a second spring disposed between the second spring holder portion of the second contact arm and the first spring support pin.

3. The contact arm assembly of claim 1, wherein the first and second braided strap portions are coupled together at an end thereof distal from the first tab member.

4. A method for assembling a contact arm assembly, comprising:

coupling a first contact on a first end portion of a first contact arm;

coupling a first braided strap portion to a first side of a first tab member of a second end portion of the first contact arm, the first tab member being rectangular shaped and further having a second side;

coupling a second braided strap portion to the second side of the first tab member of the second end portion of the first contact arm;

disposing a pivot pin through a first pivot aperture of the first contact arm;

disposing a first side plate proximate to a first side of the first contact arm;

disposing a second side plate proximate to a second side of the first contact arm such that the pivot pin extends into first and second apertures of the first and second side plates, respectively to form a first assembly;

disposing the first assembly in a cavity of a rotor housing;

disposing a first spring support pin in first and second spring support grooves of the first and second side plates, respectively;

attaching a first spring between a first spring holder portion of the first contact arm and the first spring support pin to obtain the contact arm assembly.

5. The method of claim 4, further comprising:

coupling a second contact on a second end portion of a second contact arm;

coupling a third braided strap portion to a third side of a second tab member of a third end portion of the second contact arm, the second tab member being rectangular shaped and further having a fourth side;

coupling a fourth braided strap portion to the fourth side of the second tab member of the third end portion of the second contact arm;

disposing the second contact arm between the first contact arm and the second side plate such that the pivot pin extends through the first and second pivot apertures of the first and second contact arms, respectively, and into first and second apertures of the first and second side plates, respectively, to obtain the first assembly;

attaching a second spring between a second spring holder portion of the second contact arm and the first spring support pin to obtain the contact arm assembly.

* * * * *